US009139320B2

(12) United States Patent
Mayer

(10) Patent No.: US 9,139,320 B2
(45) Date of Patent: Sep. 22, 2015

(54) PACKAGING MACHINE WITH FOREIGN SUBSTANCE DETECTION

(75) Inventor: Josef Mayer, Kempten (DE)

(73) Assignee: GEA CFS BUHL GMBH, Kempten (DE)

( * ) Notice: Subject to any disclaimer, the term of this patent is extended or adjusted under 35 U.S.C. 154(b) by 1522 days.

(21) Appl. No.: 12/598,487

(22) PCT Filed: May 5, 2008

(86) PCT No.: PCT/EP2008/003580

§ 371 (c)(1),
(2), (4) Date: Mar. 17, 2010

(87) PCT Pub. No.: WO2008/135255

PCT Pub. Date: Nov. 13, 2008

(65) Prior Publication Data

US 2010/0170205 A1 Jul. 8, 2010

(30) Foreign Application Priority Data

May 4, 2007 (EP) ..... 07009012

(51) Int. Cl.
*B65B 9/04* (2006.01)
*B65B 7/16* (2006.01)
(Continued)

(52) U.S. Cl.
CPC ..... *B65B 57/08* (2013.01); *B65B 57/16* (2013.01); *B65B 7/164* (2013.01); *B65B 9/045* (2013.01)

(58) Field of Classification Search
CPC ..... B65B 9/045; B65B 9/04; B65B 11/52; B65B 7/167; B65B 7/165; B65B 7/164; B65B 7/162; B65B 57/16; B65B 57/08
USPC ..... 53/485, 52, 505, 54, 74, 75, 76, 77, 53/559, 329, 329.2, 329.3, 329.5; 100/348
See application file for complete search history.

(56) References Cited

U.S. PATENT DOCUMENTS 1,709,196 A 4/1929 Snyder
2,395,387 A * 2/1946 Fry et al. ..... 156/365
3,054,679 A 9/1962 Bradford
(Continued)

FOREIGN PATENT DOCUMENTS

DE 1145087 3/1963
DE 1232873 1/1967
(Continued)

OTHER PUBLICATIONS

International Search Report (PCT/EP2008/003580) dated Jul. 23, 2008 published as WO2008/135255, 7 pages.
(Continued)

*Primary Examiner* — Stephen F Gerrity
(74) *Attorney, Agent, or Firm* — The Dobrusin Law Firm, P.C.

(57) ABSTRACT

The present invention relates to a packaging machine which seals a cover-film at a tray, which has been previously filled with a packaging item, whereas the packaging machine comprises an upper tool and a lower tool which are pressed together during the sealing of the cover-film to the tray, and which comprises a sensor to detect misalignment of the packaging item in the tray, a misaligned tray in the lower tool between the upper and the lower tool prior to and/or during the sealing of the cover film to the tray.

20 Claims, 6 Drawing Sheets

(51) Int. Cl.
*B65B 57/08* (2006.01)
*B65B 57/16* (2006.01)

(56) References Cited

U.S. PATENT DOCUMENTS

| | | | | | |
|---|---|---|---|---|---|
| 3,076,299 | A | | 2/1963 | Lerner | |
| 3,338,027 | A | | 8/1967 | Amberg et al. | |
| 3,760,563 | A | | 9/1973 | Zimmermann | |
| 3,792,181 | A | | 2/1974 | Mahaffy et al. | |
| 3,815,322 | A | | 6/1974 | Wyslotsky | |
| 3,958,394 | A | | 5/1976 | Mahaffy et al. | |
| 3,972,155 | A | | 8/1976 | Mahaffy et al. | |
| 4,546,596 | A | * | 10/1985 | Cherney | 53/451 |
| 4,768,327 | A | * | 9/1988 | Mosher | 53/451 |
| 5,010,712 | A | | 4/1991 | Odenthal | |
| 5,010,714 | A | | 4/1991 | Medwed et al. | |
| 5,147,491 | A | * | 9/1992 | Thomas et al. | 156/251 |
| 5,154,404 | A | * | 10/1992 | Lee, Jr. et al. | 270/58.06 |
| 5,267,638 | A | | 12/1993 | Doane | |
| 5,465,549 | A | * | 11/1995 | Lummus | 53/138.8 |
| 5,568,718 | A | * | 10/1996 | Lerner et al. | 53/75 |
| 5,603,203 | A | | 2/1997 | Robache | |
| 5,623,810 | A | | 4/1997 | Dey et al. | |
| 5,732,529 | A | | 3/1998 | Dey et al. | |
| 5,772,565 | A | * | 6/1998 | Weyandt | 493/8 |
| 5,802,804 | A | | 9/1998 | Esposti | |
| 6,044,628 | A | * | 4/2000 | Katayama et al. | 53/552 |
| 6,167,677 | B1 | * | 1/2001 | Kammler et al. | 53/75 |
| 6,732,496 | B1 | * | 5/2004 | Wessman et al. | 53/479 |
| 6,919,555 | B2 | * | 7/2005 | Fiessler | 250/221 |
| 7,286,895 | B2 | * | 10/2007 | Krieg | 700/177 |
| 7,412,861 | B2 | * | 8/2008 | Lohmann | 72/31.1 |
| 7,454,880 | B1 | | 11/2008 | Austin et al. | |
| 7,665,281 | B2 | | 2/2010 | Send | |
| 7,866,125 | B2 | * | 1/2011 | Simmons et al. | 53/472 |
| 2002/0055803 | A1 | | 5/2002 | Stork | |
| 2002/0104958 | A1 | * | 8/2002 | Fiessler | 250/221 |
| 2003/0079444 | A1 | * | 5/2003 | Behnke | 53/467 |
| 2003/0079619 | A1 | * | 5/2003 | Comley et al. | 100/38 |
| 2003/0170357 | A1 | | 9/2003 | Garwood | |
| 2003/0182903 | A1 | | 10/2003 | Garwood | |
| 2005/0060960 | A1 | * | 3/2005 | Sperry et al. | 53/450 |
| 2005/0284102 | A1 | * | 12/2005 | Herzog | 53/75 |
| 2007/0033903 | A1 | * | 2/2007 | Gertitschke et al. | 53/77 |
| 2007/0138192 | A1 | | 6/2007 | Send | |
| 2007/0157553 | A1 | * | 7/2007 | Voss et al. | 53/329 |
| 2008/0245031 | A1 | | 10/2008 | Salvoni | |
| 2010/0011718 | A1 | | 1/2010 | Donges | |

FOREIGN PATENT DOCUMENTS

| | | | | | |
|---|---|---|---|---|---|
| DE | 7245361 | | 3/1973 | | |
| DE | 7414928 | U | 10/1974 | | |
| DE | 3925746 | A1 | 2/1991 | | |
| DE | 3925796 | A1 | * | 2/1991 | 53/77 |
| DE | 4124343 | | | 1/1993 | |
| DE | 4216210 | A1 | | 11/1993 | |
| DE | 69414411 | B1 | | 4/1999 | |
| DE | 10031356 | A1 | | 1/2002 | |
| DE | 102005014668 | A1 | | 10/2006 | |
| EP | 0186729 | | | 7/1988 | |
| EP | 0388361 | A | | 9/1990 | |
| EP | 0569937 | A1 | | 11/1993 | |
| EP | 680880 | A1 | | 11/1995 | |
| EP | 0489797 | B1 | | 1/1996 | |
| EP | 0847920 | A1 | | 6/1998 | |
| EP | 0899209 | A2 | | 3/1999 | |
| EP | 0949147 | A1 | | 10/1999 | |
| EP | 1106511 | A | | 6/2001 | |
| FR | 1477481 | A1 | * | 4/1967 | B65B 57/16 |
| FR | 2606364 | A1 | | 5/1988 | |
| FR | 2618523 | A1 | * | 1/1989 | 53/77 |
| GB | 857973 | | | 1/1961 | |
| JP | 08 217007 | A | | 8/1996 | |
| JP | 09-030504 | A1 | | 2/1997 | |
| JP | 09-030505 | A1 | | 2/1997 | |
| JP | 2005-024549 | A1 | | 1/2005 | |
| JP | 2006-298384 | A1 | | 11/2006 | |
| JP | 2007-106468 | A1 | | 4/2007 | |
| WO | 03/037719 | A | | 5/2003 | |
| WO | 2005/042349 | A1 | | 5/2005 | |
| WO | 2005/075291 | A1 | | 8/2005 | |
| WO | 2006/092289 | | | 9/2006 | |

OTHER PUBLICATIONS

European Search Report dated Apr. 23, 2008 EP07009012, 4 pages.
Co-Pending U.S. Appl. No. 11/530,503, filed May 27, 2008, published as 2008-0245031.
Co-Pending U.S. Appl. No. 12/441,596, filed Jul. 27, 2009, published as 2010/0011718.
Co-Pending U.S. Appl. No. 11/181,037, filed Jul. 13, 2005, patented as 7,665,281.
Co-Pending U.S. Appl. No. 11/609,637, filed Dec. 12, 2006, published as 2007/0138192.
Opposition, EP 1988024B1 dated Jun. 9, 2011, 21 pages.
Opposition, EP1988024, dated May 3, 2011, 12 pages.
Messecheckliste Interpack 2002 (D7.0), 2 pages.
Standplan Inerpack 2002 (D7.1), 2 pages.
Multivac, Jan. 9, 2002 (D7.2), 6 pages.
Elektroschaltplan T400_0069_Feb. 26, 2002 (D7.3), 4 pages.
Technische Dokumentation Fur die Nachrustund, Multivac, dated Mar. 5, 2011(D7.4), 4 pages.
Maschinzeichnung (D7.6), 1 page.
Multivac, Jul. 9, 2003 (D7.3a), 1 page.
Multivac, Apr. 5, 2004 (D7.3b), 1 page.
Photograph (date unknown) (D7.5a), 1 page.
Photograph (date unknown) (D7.5b), 1 page.
European Search Report dated Apr. 23, 2008 EP7009012, 4 pages.

* cited by examiner

PACKAGING MACHINE WITH FOREIGN SUBSTANCE DETECTION

FIELD

The present invention is related to a packaging machine which seals a cover film to a tray which has been previously filled with a packaging item, whereas the packaging machine comprises an upper tool and a lower tool which are pressed together during the sealing of the cover film to the tray. The present invention is further related to a process to produce a packaging item.

BACKGROUND

The above-mentioned packaging machines are well known from the state of the art and are for example so-called form-fill-seal packaging machines which form a plastic film into a tray. This tray is filled with the packaging item and subsequently closed with a cover plastic film. Another packaging machine is a so-called traysealer in which preformed trays are filled with a packaging item and then sealed with a cover film. The sealing of the cover film to the tray is in both cases executed by exposing the cover film and/or the tray to heat and pressing the cover film and the tray together. This pressure is for example applied by pressing an upper tool which is located above the cover film and a lower tool which is located below the tray together. In the past, it has happened often, that the upper tool and/or the lower tool have been damaged during the sealing operation, so that at least one of the tools had to be replaced and the packaging machine was not in operation for an extended period of time.

SUMMARY

It was therefore the objective of the present invention to overcome the deficiencies of the packaging machines according to the state in the art.

This problem is solved with a packaging machine which seals a cover-film at a tray, which has been previously filled with a packaging item, whereas the packaging machine comprises an upper tool and a lower tool which are pressed together during the sealing of the cover-film to the tray and which comprises means to detect a misaligned packaging item in the tray, a misaligned tray or another foreign object between the lower tool and the upper tool prior to and/or during the sealing of the cover film to the tray.

It was totally surprising and could not have been expected by a person skilled in the art that damage of the upper and/or lower tool can be avoided by the inventive packaging machine. The inventive packaging machine is easy to build and to operate.

The inventive packaging machine is for example a so-called form-fill-seal packaging machine. This packaging machine comprises a forming station in which a planar plastic film is formed into a multitude of trays which are subsequently filled with a packaging item and then sealed with a cover plastic film in a so-called sealing unit. Another example for a packaging machine according to the present invention is a so-called traysealer in which essentially flat or pre-formed plastic trays are filled and subsequently sealed with a cover plastic film in a sealing unit.

The cover film can be a film to cover the tray or a so-called skin-film which is shrunk around the packaging item. In another preferred embodiment, the cover film is formed into a three dimensional object.

The tray can be flat or a three dimensional object with a mould.

The sealing unit within the inventive packaging machine normally comprises an upper and a lower tool, which are pressed together during the sealing of the cover film to the tray. At least one of these tools is heated so that heat can be applied to one of the film and/or to the tray during the sealing operation. In order to press the tools together, at least one of the tools comprise driving means which move the respective tool up and down. In a preferred embodiment, however, the upper tool is stationary and the lower tool is moved up and down. At least one of the tools can comprise cooling means to cool the respective tool in certain regions, to avoid undesired shrinkage of the cover film and/or the tray in case shrinkable films are used.

According to the present invention, the packaging machine especially the sealing station comprises means to detect a misaligned packaging item in the tray, a misaligned tray or another foreign object between the upper and the lower tool prior to and/or during the sealing of the cover film to the tray. This is done to avoid, that the packaging item extends into the sealing area between the upper and the lower tool and damages at least one of these tools when they are pressed together during the sealing action. The same holds true for foreign objects between the upper tool and the lower tool. The means also detect a tray, which is not properly aligned in the lower tool; e.g. which has not been properly inserted into the lower tool by the grippers.

As soon as these means detect a misaligned packaging items in the tray, a misaligned tray and/or a foreign body between the upper and the lower tool, the movement of at least one of these tools is stopped.

Preferably, the upper tool and/or the lower tool comprise driving means, which execute the preferably vertical movement of the upper and/or lower tool. However, preferably the upper tool is stationary and only the lower tool is moved vertically.

These driving means are preferably designed such that the velocity and/or position of the upper and/or lower tool can be determined by a control unit, for example a computer, which controls the driving means. Preferably, the driving means are a motor, more preferably a servo motor, a linear motor and/or a pneumatic or hydraulic cylinder. The control unit stops the driving means immediately after a foreign object or a misaligned packaging item has been determined.

In a preferred embodiment of the present invention, the means to detect foreign objects, misaligned trays or a misaligned packaging item between the tools is a camera, preferably a high-speed camera. This camera is connected to computer means which analyze the pictures submitted by the camera for foreign objects or a misaligned packaging item and which send a "stop" signal to the driving means as soon as they have detected such object or a misaligned packaging item between the upper and the lower tool. The camera preferably inspects the region between the cover film and the lower tool. In another preferred embodiment, the camera is used to detect a deflection of the cover film caused by a foreign object, a misaligned packaging item and/or misaligned tray. The camera can also be used to detect the, preferably first contact between the above mentioned packaging item, tray and/or foreign object. In this case the camera inspects preferably the region between the cover film and the lower tool.

In another preferred embodiment, the means to detect foreign objects, misaligned tray or a misaligned packaging item is a pressure sensor which is preferably located in the upper tool. This pressure sensor preferably sensors the pressure which occurs before the upper and the lower tool are in contact with each other. If such a pressure is sensored, the control unit which is connected to the packaging machine, knows that there must be a foreign object or a misaligned packaging item between the tools. Preferably, the packaging machines additionally comprises means which are able to determine the position of the upper and/or lower tool so that the inventive machine knows when the contact between the upper and the lower tool should take place. If a pressure is sensored prior to this instant, a foreign object or a misaligned packaging item must be between the upper and the lower tool and the movement of at least one of the tools is stopped preferably instantaneously.

In another preferred embodiment, the means to detect foreign objects, misaligned tray or a misaligned packaging item is a sensor to measure the tension of the cover film. As soon as a foreign object or a misaligned packaging item is moved against the cover film, the film stretches and its tension increases. An analyzing tool which is connected to the sensor can stop the movement of the upper and/or lower tool immediately if such an increased pressure is sensored. This sensor can be for example connected to a dancer and measures its deflection. The sensor can be also a pressure measurement for example in a role which allows conclusions about the tension in the film.

In an other preferred embodiment, the inventive machine comprises a sensor which measures the deflection of the cover film, which can only be deflected by a foreign object, misaligned tray or a misaligned packaging item. As soon as such a deflection takes place, the analyzing means which are connected to the sensor, know that a foreign object must be between the upper and the lower tool and stop the movement of the upper and the lower tool instantaneously. This sensor can be for example a camera.

In an other preferred embodiment, the means to detect a foreign object, misaligned tray or a misaligned packaging item between the upper and the lower tool is a sensor based on an ultrasonic sound. This sensor comprises an emitter which emits the ultrasonic sound and a receiver which receives the reflection of the ultrasonic sound. Based on the signal received by the receiver, analyzing means can detect, whether a foreign object is between the upper and the lower tool and stop the movement of the upper and the lower tool immediately if such a foreign object is present.

In an other preferred embodiment, the means are based on radiation. This preferred embodiment works like the sensor based on ultrasonic sound but with radiation. The radiation can be X-rays, light or a laser. The light is preferably infrared, red light and/or blue light.

In even an other preferred embodiment, the packaging machine comprises means that measure the actual operating velocity of the upper and/or the lower tool. These velocities are compared with reference velocities and if the measured velocity is not in a certain range around the reference velocity, especially if the velocity is lower than the reference velocity, analyzing means, for example a computer, conclude that the upper and/or lower tool have been decelerated by a foreign object, a misaligned tray or a misaligned packing item between the upper and the lower tool and stop the movement of at least one of those tools immediately.

In yet another preferred embodiment, the inventive machine comprises at least a strain gage which measures the deformation of the upper and/or the lower tool, preferably the upper tool. The strain gage especially measures if a deformation takes place before the two tools contact each other. If a unexpected deformation takes place, analyzing means, for example a computer, which receive the signal from the strain gage know that there is a foreign object and/or a misaligned packing item between the upper and the lower tool and stop the movement of at least one tool immediately. In an other preferred embodiment, the strain gage is connected to the driving means of the upper and/or lower tool and function as described above.

In another preferred embodiment, the inventive packaging machine measures the power, i.e. the current and/or the voltage which is consumed by the driving means. This value is compared with a reference value and if this comparison is not in a certain range, the upper and/or the lower tools are stopped instantaneously by analyzing means which analyze the measured signals.

Preferably the upward movement of the lower tool and/or the downward movement of the upper tool is not constant and more preferably decreases with the reduction of the gap between the upper tool and the lower tool. More preferably also the reverse movement is not constant.

The inventive packaging machine can be any packaging machine known by a person skilled in the art, preferably the packaging machine is a so-called form-fill-seal packaging machine or a traysealer.

The packaged goods are preferably food, most preferably food that comprises proteins like meat, sausage and/or cheese.

The above-mentioned detection means can be combined among each other, for example to achieve redundancy.

All above mentioned detection means can be movable, for example rotatable, to achieve a wider detection range.

An other subject matter of the present invention is a process to produce packaging items by sealing a cover-film to a tray by pressing an upper tool and a lower tool together, whereas the gap between the tools is at least partially monitored and that the movement of at least one tool is stopped in case a foreign body or a misaligned packaging item is detected.

The above disclosure regarding the packing machine is also applicable to the inventive process.

BRIEF DESCRIPTION

The inventive packaging machines and the inventive process are now described according to FIGS. 1-5. These descriptions do not limit the scope of protection and apply to the inventive packaging machine as well as the inventive process.

DETAILED DESCRIPTION

Figure 1:
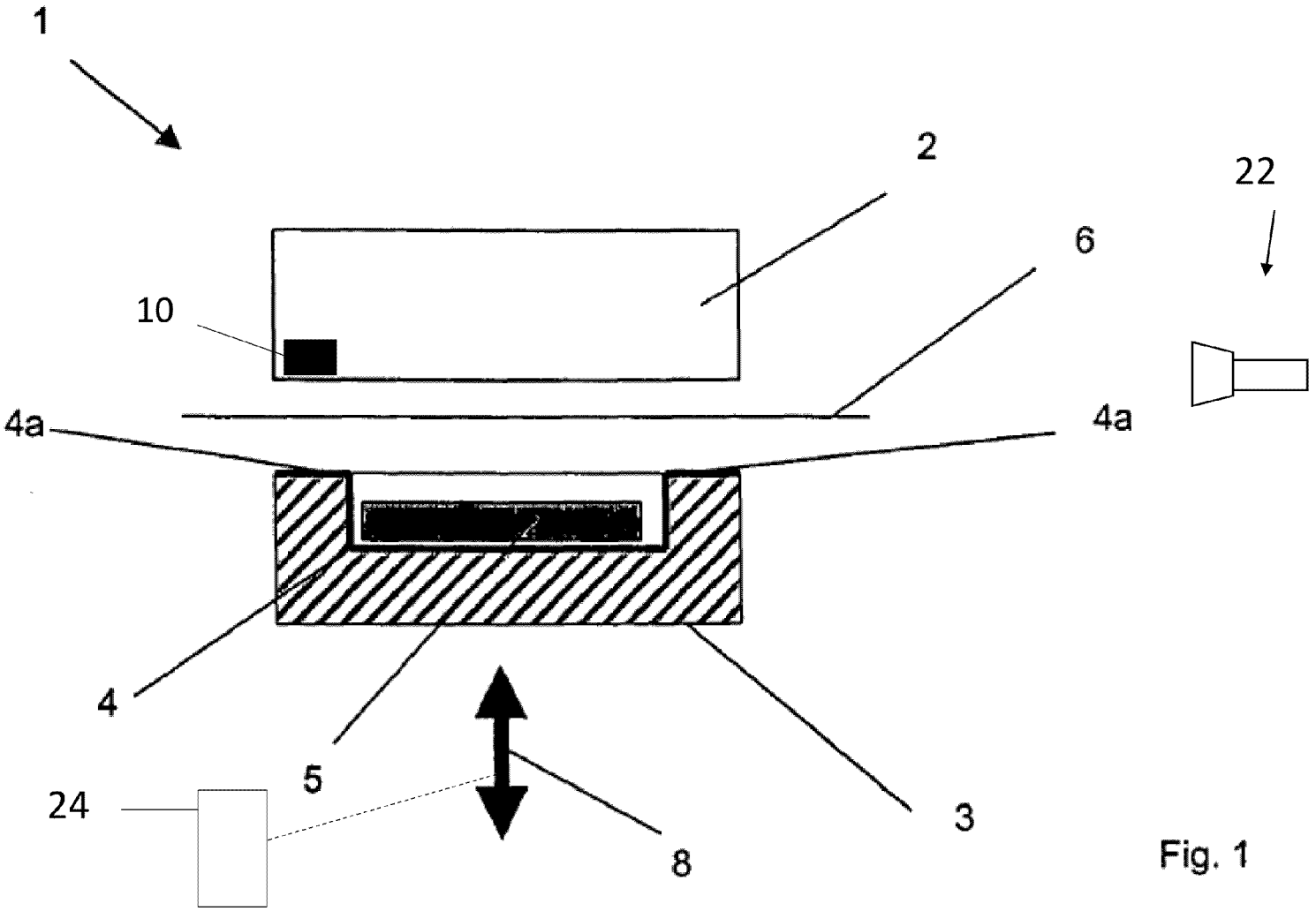
FIG. 1 shows the sealing station of the inventive packaging machine.

FIG. 1 shows the sealing station 1 of the inventive packaging machine. The inventive packaging machine is in this case a traysealer, in which pre-formed plastic trays 4 are each filled with a packaging item 5. Subsequently, these filled trays 4 are inserted into a lower tool 3 which is a sealing tool and part of the sealing station. This sealing station comprises beside the lower tool 3 an upper tool 2, which is in the present case stationary. The upper and or the lower tool comprise heating elements in order to be able to seal the cover film to the tray under the influence of heat. Between the two tools prior to sealing, a cover film 6 will be located. Subsequently, the lower tool 3 is moved vertically towards the upper tool until they are in contact with each other and then pressed together. A pressure sensor 10 is located in the upper tool 2 that measured pressure between the upper tool 2 and lower tool 3. Due to this pressure and in the presence of heat, the cover film 6 is sealed to the sealing area 4*a* of the tray 4. A means 22 measures an actual operating-velocity of the upper 2 and/or lower tool 3. The person skilled in the art understands that the cover film 6 can also be sealed to a different location at the tray. After the sealing and cutting is finalized, the lower tool is moved downwards and the completed packages are removed from the lower tool. The vertical movement as well as the pressing action is utilized by driving means 8 which comprise a motor in combination with a gear or a piston with a gear. The driving means 8 includes a means 24 that measures power input to the driving means 8 and compares the power input with a reference power. Preferably, the driving means 8 are designed such, that they provide signals which allow conclusions of the lower tool at every instant. Such a motor is for example a servo motor. In the present example, the upper tool 2 is fixed and the lower tool 3 is moved upwards and downwards. After the sealing action has been taken place, the lower tool 3 is moved vertically downwards and the finished package is removed. Before or after the sealing, the covers are cut out of the cover film 6.

Figure 2:
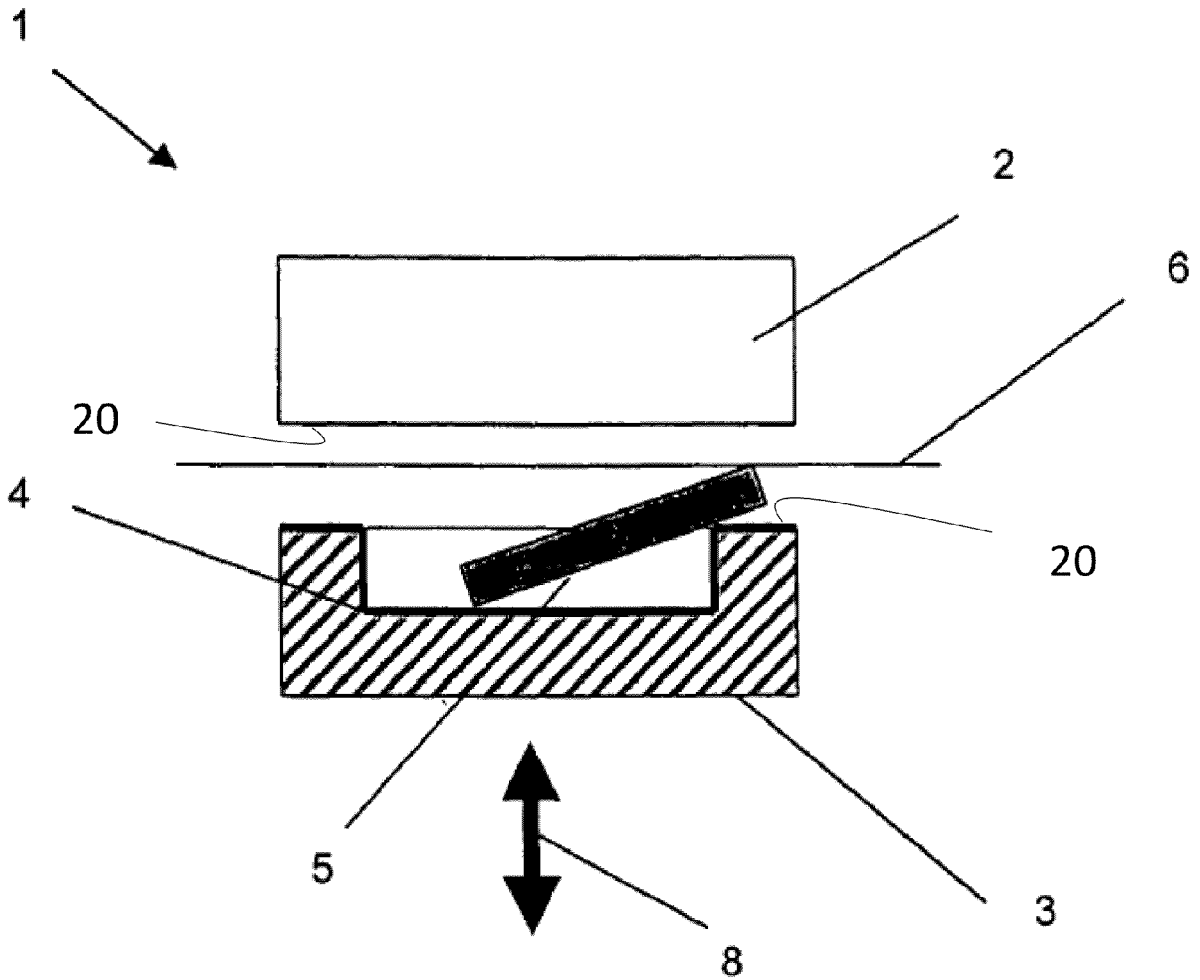
FIG. 2 shows the sealing station according to FIG. 1 with a misaligned packaging item.

FIG. 2 shows the sealing station according to FIG. 1. However, in the present case, the packaging items 5, for example loin ribs, which comprises a bone is misaligned and extends out of the trough of the tray into the sealing area. Another example is any other foreign object, which should not be between the two tools. In case that the lower tool 3 is now moved upwards and then pressed with a high force against the upper tool 2, the packaging item 5 is crushed between the two tools and potentially destroys one of those tools so that they have to be replaced. As shown the upper tool 2 and the lower tool 3 include a strain gauge 20 that monitors for deformation of the upper tool 2 and/or the lower tool and/or the driving means 8.

Figure 3A:
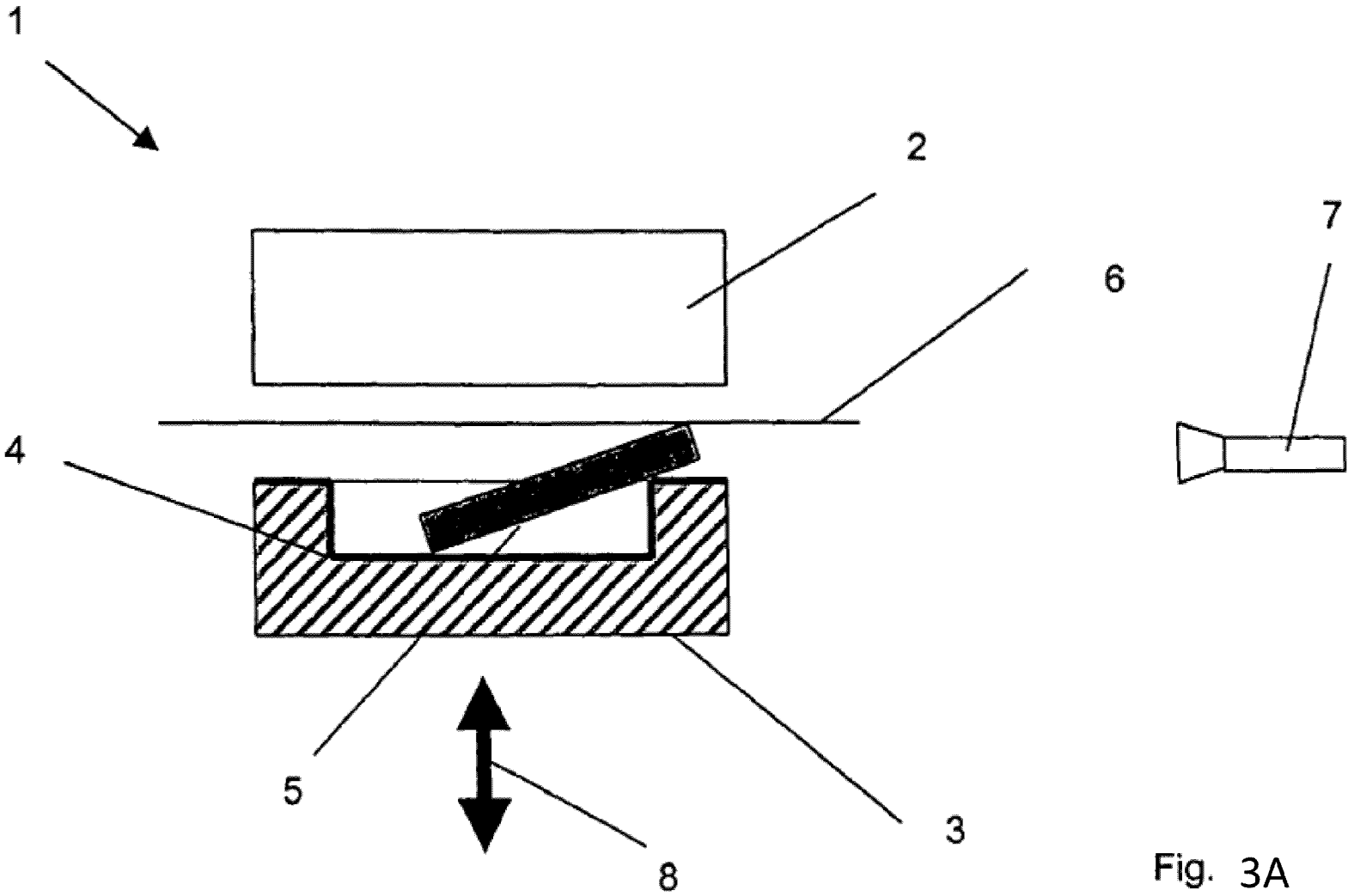
FIG. 3A shows the inventive packaging machine with a camera.

One embodiment of the present invention is shown in FIG. 3A. In this case, the machine comprises a high speed camera 7 which observes the gap between the upper and the lower tool at least partially. The pictures taken by the camera are processed by a computer (not shown) which analyzes the pictures. As soon as the computer detects a foreign object or a misaligned packaging item 5, in this case a bone of a rib, the driving means 8 are stopped immediately so that a destruction of the packaging item as well as the upper and/or the lower tool can be avoided. The camera 7 is preferably located below the cover film 6. After stopping the lower tool, a warning signal is sent and subsequently the lower tool is either automatically or manually lowered so that an operating person can inspect the sealing station and remove the disturbing object.

Figure 3B:
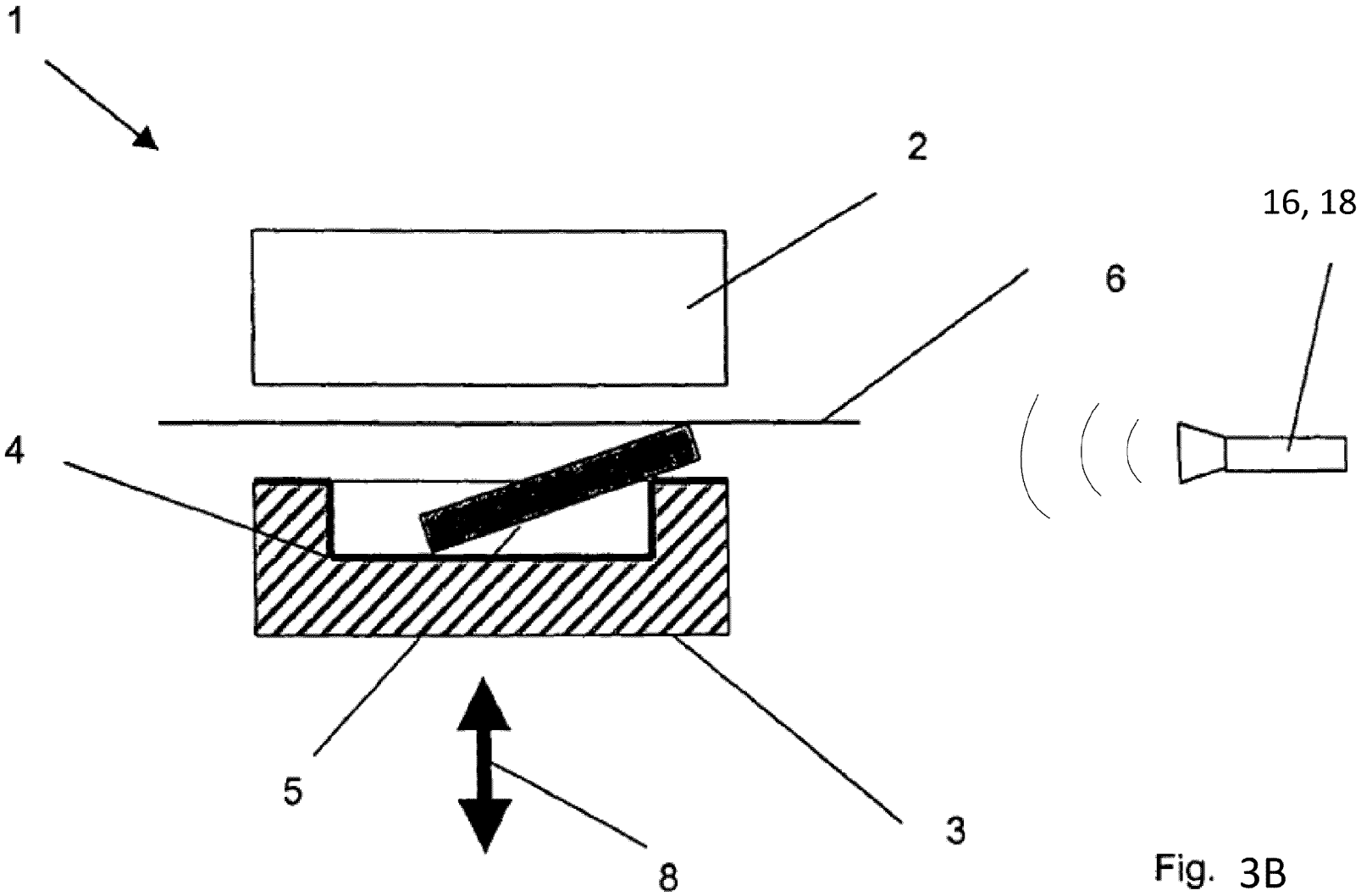
FIG. 3B shows the inventive packaging machine with a sensor that uses ultrasound and/or radiation.

FIG. 3B illustrates a sensor that uses ultra sound 16 and/or radiation 18 to monitor the gap between the upper tool 2 and the lower tool 3.

Figure 4:
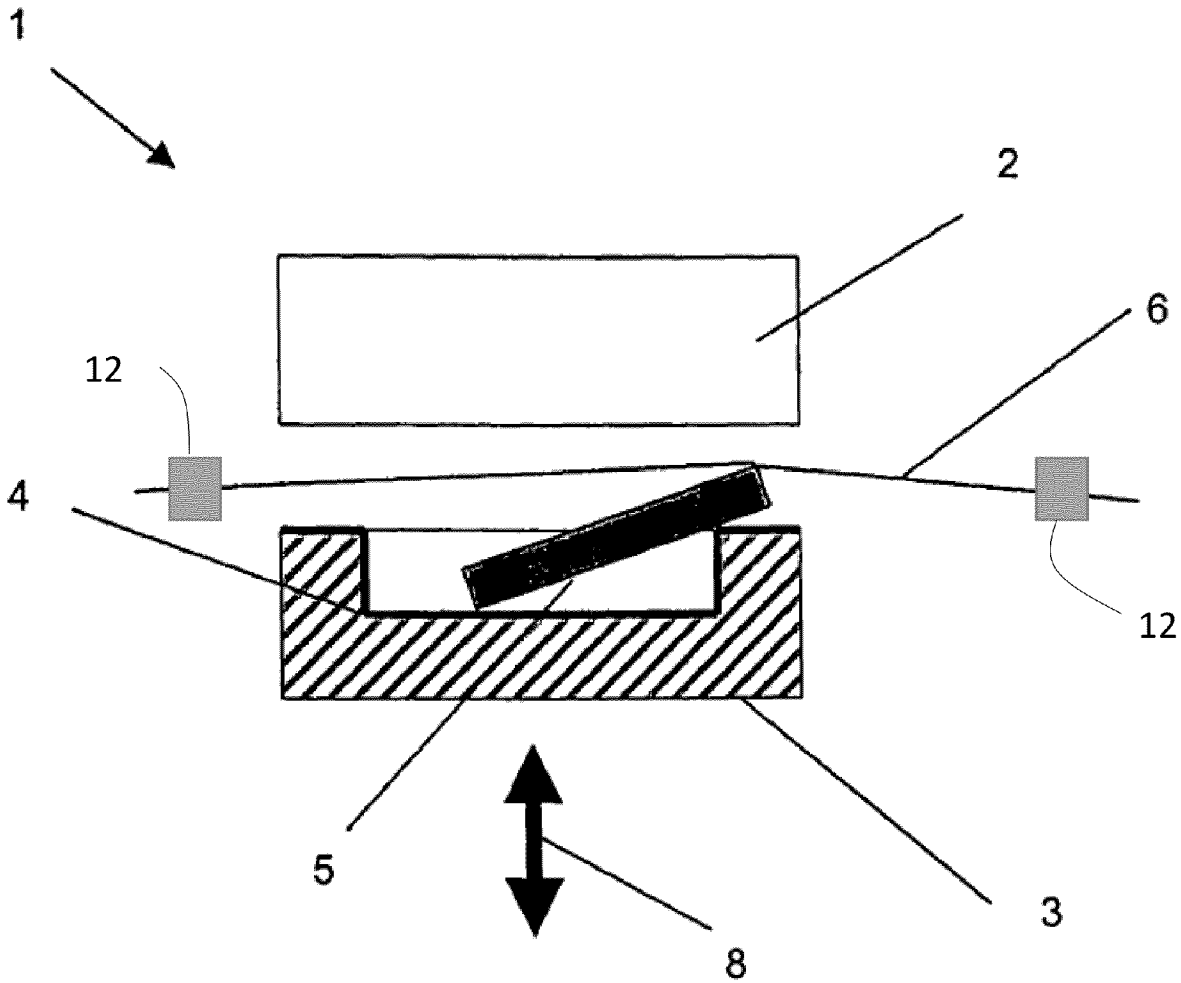
FIG. 4 shows the inventive packaging machine with tension, detection and/or deflection detection means.

In an other embodiment or additionally, the inventive packaging machine comprises sensors which measures the tension and/or deflection of the cover film 6 which is shown in FIG. 4. Due to the misalignment of the packaging item 5, the cover film 6 is deflected during the upward movement of the lower tool. Additionally, the tension of the cover film increases due to the upward movement of the lower tool. This deflection and/or the tension can be measured by a sensor 12. This signal is again submitted to a computer unit which analyzes the signals and as soon as an unexpected deflection and/or an unexpected increase in tension is detected, the driving means 8 stop.

Figure 5:
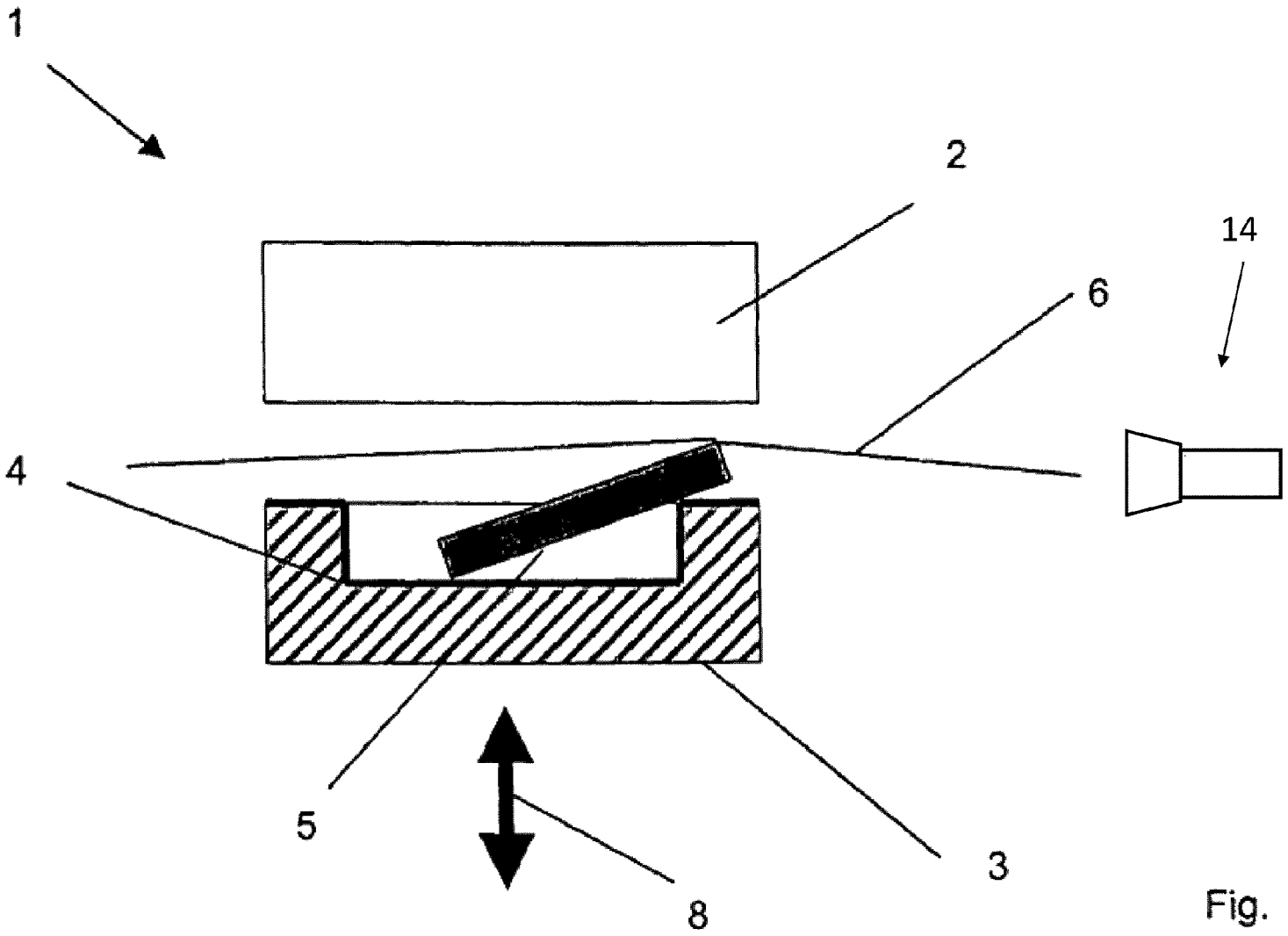
FIG. 5 shows the inventive packaging machine with a sensor that measures deflection.

FIG. 5 illustrates another sensor 14 that detects deflection of the cover film 6 due to misalignment of the packaging item 5 in the filled tray 4.

The invention claimed is:

1. A packaging machine which seals a cover-film to a tray, which has been previously filled with a packaging item wherein the packaging machine comprises:

i. an upper tool;

ii. a lower tool which are pressed together during the sealing of the cover-film to the tray; and iii. a means to detect misalignment of the packaging item in the tray and/or misalignment of the tray in the lower tool prior to and/or during the sealing of the cover film to the tray; and wherein the means monitors a space between the upper tool and the lower tool and upon detection of the misalignment of the packaging item in the tray and/or misalignment of the tray in the lower tool a signal is sent so that the upper tool and the lower tool are stopped and protected from damage.

2. The packaging machine, according to claim 1, wherein the upper tool and/or the lower tool are driven by driving means.

3. The packaging machine according to claim 2, wherein the means is a high-speed-camera that monitors the space between the upper tool and the lower tool.

4. The packaging machine according to claim 1, wherein the means is a camera.

5. The packaging machine according to claim 1, wherein the means is a pressure sensor, in the upper tool.

6. The packaging machine according to claim 1, wherein the means is a sensor that measures the tension of the cover film.

7. The packaging machine according to claim 1, wherein the means is a sensor that measures the deflection of the cover-film.

8. The packaging machine according to claim 1, wherein the means is a sensor based on ultra sonic sound.

9. The packaging machine according to claim 1, wherein the means is a sensor based on radiation.

10. The packaging machine according to claim 1, that the means is a strain gage that measures the deformation of the upper tool and or the lower tool and/or driving means.

11. The packaging machine according to claim 1, wherein the means comprises means that measure an actual operating-velocity of the upper- and/or lower tool and compares the actual operating-velocity of the upper- and/or lower tool with a reference velocity.

12. The packaging machine claim 1, wherein the packaging machine comprises means that measure power input to driving-means and compares the power input with a reference power.

13. The packaging machine according to claim 1, wherein the packaging machine is a traysealer.

14. The packaging machine according to claim 1, wherein the packaging item is food that comprises protein or non-food.

15. The packaging machine according to claim 1, wherein the packaging machine includes a control until and a driving means and upon the detection of the misalignment of the packaging item in the tray and/or misalignment of the tray in the lower tool by the means the control unit stops the driving means.

16. A process to produce packaging items comprising:

sealing a cover-film to a tray by pressing an upper tool and a lower tool together, monitoring at least part of a space between the upper tool and the lower tool;

stopping movement of the upper tool, the lower tool, or both in case of misalignment of the packaging items and/or misalignment of the tray in the lower tool is detected in the monitoring step prior to and/or during the sealing of the cover-film to the tray.

17. The process according to claim 16, wherein the process includes a step of filling a tray with a packaging item prior to sealing the cover-film to the tray, and monitoring the space between the upper tool and the lower tool with a means to detect misalignment of the packaging item in the tray and/or misalignment of the tray in the lower tool prior to and/or during the sealing of the cover-film to the tray.

18. The process according to claim 17, wherein the process includes a step of measuring tension of the cover-film with the means so that misalignment of the packaging item in the tray and/or the misalignment of the tray in the lower tool stretches the film and increases tension of the film so that the means sends a signal so that movement of the upper tool and/or lower tool are stooped.

19. The process according to claim 17, wherein the means is a camera and the camera is connected to computer means and wherein the process includes a step of the computer means analyzing pictures submitted by the camera for foreign objects or misaligned packaging items and sends a stop signal to a driving means as soon as an object or misaligned packaging items are detected between the upper tool and the lower tool.

20. The process according to claim 17, wherein the means is a camera and wherein the process includes a step of detecting a deflection of the cover-film caused by a foreign object, a misaligned packaging item, and/or misaligned tray.

* * * * *